US009138762B2

(12) United States Patent
Mirazita et al.

(10) Patent No.: US 9,138,762 B2
(45) Date of Patent: Sep. 22, 2015

(54) TEXTURE SPRAY GUN

(75) Inventors: Frank G. Mirazita, Sussex, NJ (US); Sandor Peter Veres, Mahwah, NJ (US); Michael Dosch, Lake Hiawatha, NJ (US); Andrew Jason Dany, Mahwah, NJ (US)

(73) Assignee: TITAN TOOL, INC., Plymouth, MN (US)

( * ) Notice: Subject to any disclaimer, the term of this patent is extended or adjusted under 35 U.S.C. 154(b) by 1315 days.

(21) Appl. No.: 12/304,387

(22) PCT Filed: Jun. 11, 2007

(86) PCT No.: PCT/US2007/070897

§ 371 (c)(1), (2), (4) Date: May 4, 2009

(87) PCT Pub. No.: WO2007/146886

PCT Pub. Date: Dec. 21, 2007

(65) Prior Publication Data

US 2009/0320752 A1 Dec. 31, 2009

Related U.S. Application Data

(60) Provisional application No. 60/804,528, filed on Jun. 12, 2006.

(51) Int. Cl.

| | |
|---|---|
| ***B05B 7/00*** | (2006.01) |
| ***B05B 7/04*** | (2006.01) |
| ***B05B 7/06*** | (2006.01) |
| ***B05B 7/12*** | (2006.01) |

(Continued)

(52) U.S. Cl.

CPC ..... *B05B 7/1209* (2013.01); *B05B 7/0433* (2013.01); *B05B 7/065* (2013.01); *B05B 7/12* (2013.01); *B05B 15/02* (2013.01); *B05B 15/025* (2013.01); *B05B 12/002* (2013.01); *B05B 12/02* (2013.01); *B05B 15/061* (2013.01)

(58) Field of Classification Search

None

See application file for complete search history.

(56) References Cited

U.S. PATENT DOCUMENTS

| | | | | |
|---|---|---|---|---|
| 1,662,042 | A | 3/1928 | Blrkenmaier | |
| 1,819,115 | A * | 8/1931 | Preble et al. | 239/300 |

(Continued)

FOREIGN PATENT DOCUMENTS

| | | | |
|---|---|---|---|
| DE | 29 26 286 | A1 | 1/1981 |
| EP | 0 572 237 | A | 12/1993 |

(Continued)

OTHER PUBLICATIONS

International Search Report for PCT/US2007/070897 completion dated Jan. 10, 2008, mailed Jan. 17, 2008, 18 pages.

(Continued)

*Primary Examiner* — Dah-Wei D Yuan

*Assistant Examiner* — Binu Thomas

(74) *Attorney, Agent, or Firm* — Christopher J. Volkmann; Kelly, Holt & Christenson, PLLC

(57) ABSTRACT

A texture spray gun having an air passageway (29) and a texture material passageway (28) in a handle (14) of the gun do) and a selectively removable screw to convert the gun from a non-air bleed configuration to an air bleed configuration and an improved air valve (22) providing a minimum air flow regardless of the setting of the air valve (22), preventing texture material from clogging an air path at the outlet of the gun.

11 Claims, 24 Drawing Sheets

(51) Int. Cl.

| | |
|---|---|
| ***B05B 12/12*** | (2006.01) |
| ***B05B 15/02*** | (2006.01) |
| *B05B 12/02* | (2006.01) |
| *B05B 12/00* | (2006.01) |
| *B05B 15/06* | (2006.01) |

(56) References Cited

U.S. PATENT DOCUMENTS

| | | | | | |
|---|---|---|---|---|---|
| 1,872,058 | A | | 4/1932 | Bramsen et al. | |
| 1,982,056 | A | * | 11/1934 | Jenkins | 239/301 |
| 2,804,343 | A | * | 8/1957 | Friedell | 239/528 |
| 2,888,207 | A | * | 5/1959 | Sykes | 239/528 |
| 3,352,333 | A | | 11/1967 | Glasgow et al. | |
| 3,685,743 | A | * | 8/1972 | Sebastiani | 239/415 |
| 4,961,537 | A | | 10/1990 | Stern | |
| 4,978,072 | A | | 12/1990 | Kurowski | |
| 5,119,993 | A | | 6/1992 | Gunzel, Jr. et al. | |
| 5,190,225 | A | | 3/1993 | Williams | |
| 5,225,846 | A | | 7/1993 | Koyama | |
| 5,232,161 | A | | 8/1993 | Clemmons | |
| 5,236,129 | A | | 8/1993 | Grime et al. | |
| 5,289,974 | A | | 3/1994 | Grime et al. | |
| 5,299,741 | A | * | 4/1994 | Murphy | 239/124 |
| 5,330,108 | A | | 7/1994 | Grime et al. | |
| 5,332,159 | A | | 7/1994 | Grime et al. | |
| 5,409,166 | A | | 4/1995 | Gunzel, Jr. et al. | |
| 5,727,736 | A | | 3/1998 | Tryon | |
| 5,803,360 | A | | 9/1998 | Spitznagel | |
| 5,810,258 | A | | 9/1998 | Wu | |
| 5,918,815 | A | | 7/1999 | Wu | |
| 5,979,797 | A | * | 11/1999 | Castellano | 239/346 |
| 6,012,651 | A | | 1/2000 | Spitznagel | |
| 6,053,436 | A | | 4/2000 | Morford | |
| 6,062,494 | A | | 5/2000 | Mills | |
| 6,070,809 | A | | 6/2000 | Price | |
| 6,092,740 | A | | 7/2000 | Liu | |
| 6,168,093 | B1 | | 1/2001 | Greer, Jr. et al. | |
| 6,213,410 | B1 | | 4/2001 | Spitznagel | |
| 6,366,857 | B1 | | 4/2002 | Bird et al. | |
| 6,536,684 | B1 | | 3/2003 | Wei | |
| 6,712,292 | B1 | | 3/2004 | Gosis et al. | |
| 6,726,125 | B1 | | 4/2004 | Nonis et al. | |
| 6,863,227 | B2 | | 3/2005 | Wollenberg et al. | |
| 2003/0010843 | A1 | | 1/2003 | Liao | |

FOREIGN PATENT DOCUMENTS

| | | | |
|---|---|---|---|
| GB | 1 125 167 | A | 8/1968 |
| WO | WO 03-024608 | A | 3/2003 |

OTHER PUBLICATIONS

Compressor Care on the Web, www.compressor-care.com/it060017.html accessed Jun. 23, 2005. pp. 2.

Graco Texture Spray Gun Instructions—Parts List; revised Sep. 2002; 2 pp.

Homax Pneumatic II Spray Texture Gun—www.acehardware.com/product/index accessed Jun. 23, 2005; pp. 1.

Air Texture Gun Sprays Liquid Drywall Materials www.northerntool.com/webapp/wcs/stores/servlet/ProductDisplay accessed Jun. 23, 2005. pp. 2.

Front Range Tool Warehouse, Bailey, CO www.dropshipdiscount-tools.com/show accessed Jun. 23, 2005. pp. 1.

Graco Professional Hopper Gun www.o-geepaint.com/Sprayers/Tex.shtml accessed Jun. 23, 2005. pp. 2.

EZ-TEX Rotortex P/N 19-200 Texture Sprayer 2005 Owner Manual Benron Equipment & Supply Van Nuys, CA; pp. 18.

GRACO Texture Sprayers Graco's Complete Line of Professional Texture Sprayers and Acessories; Graco Inc. 2008. pp. 1-26.

BES Texture Guns http://www.benron.com/texure_gun.html accessed on Jun. 25, 2009. pp. 1-7.

Binks 7E2 Texture Spray Gun, www.portlandcompressor.com/store/p-3384-binks_-7e2-spray-gun-texture.aspx, accessed on Jun. 25, 2009; pp. 1-5.

Kodiak Pole Guns and Tips; www.dyrwalltools.com/texturing_accessories.php accessed on Jun. 25, 2009. pp. 1-2.

MARSHALLTOWN Enforcer Portable Texture Sprayer Sell Sheet www.MARSHALLTOWN.com pp. 1.

English Translation of the First Office Action for Counterpart Chinese Patent Application No. 2007800220743, dated Feb. 22, 2011.

* cited by examiner

TEXTURE SPRAY GUN

CROSS-REFERENCE TO RELATED APPLICATION

This application claims the benefit of U.S. Provisional Application 60/804,528, filed Jun. 12, 2006, the entire contents of which are hereby expressly incorporated by reference.

BACKGROUND OF THE INVENTION

The present invention relates to a hand-held spray gun for spraying texture material on architectural surfaces such as ceilings and walls. The texture material is a semi-solid material in the form of a slurry which is typically applied using air in combination with the slurry to propel and disperse the slurry towards the surface to be coated.

BRIEF SUMMARY OF THE INVENTION

This invention is an ergonomically designed spray gun to spray texture material and is convertible from a non-air bleed configuration to an air bleed configuration, provided that the air valve is set to provide some air flow. The conversion between non-bleed and air bleed is performed by removing a screw from the rear end of the spray gun main shaft which opens the center bore of the shaft to the air chamber within the spray gun body. With the screw removed and air being supplied to the spray gun, the spray gun will bleed air continuously through the air nozzle, regardless of the trigger location. With the screw in place and air being supplied to the spray gun, the gun will only bleed air when the trigger is actuated. In the first embodiment, an air valve may be used to control the flow of air from completely OFF to completely ON (open) air flow path.

In a second embodiment, the air valve of the texture gun always bleeds a slight amount of air to prevent the texture material from clogging the gun when the trigger is depressed and the air valve is set to a "closed" or OFF position. The second embodiment will provide at least a small amount of air to the needle regardless of the position of the air valve.

The invention also includes the aspect wherein the texture material flow path and the air flow path both are contained within the gun handle, resulting in a more ergonomic weight balance for the user.

DETAILED DESCRIPTION

Figure 1:
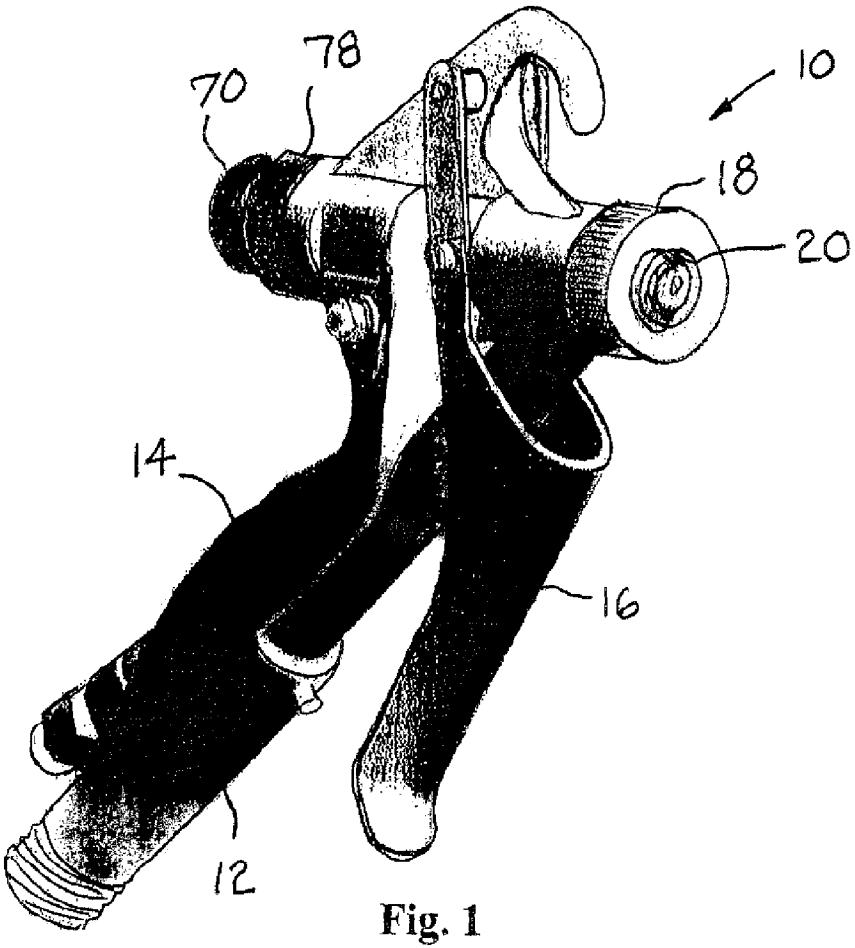
FIG. 1 is a first perspective view from the right side and to the front of a texture gun useful in the practice of the present invention.
Figure 2:
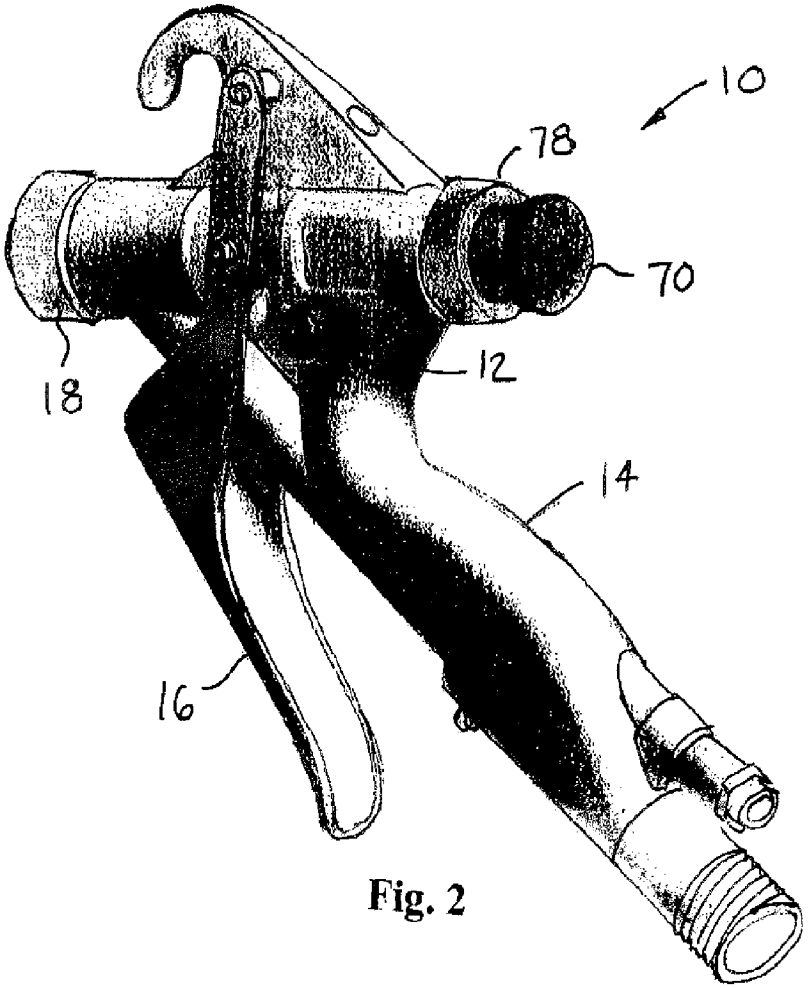
FIG. 2 is a second perspective view from the left side and to the rear of the texture gun of FIG. 1.
Figure 3:
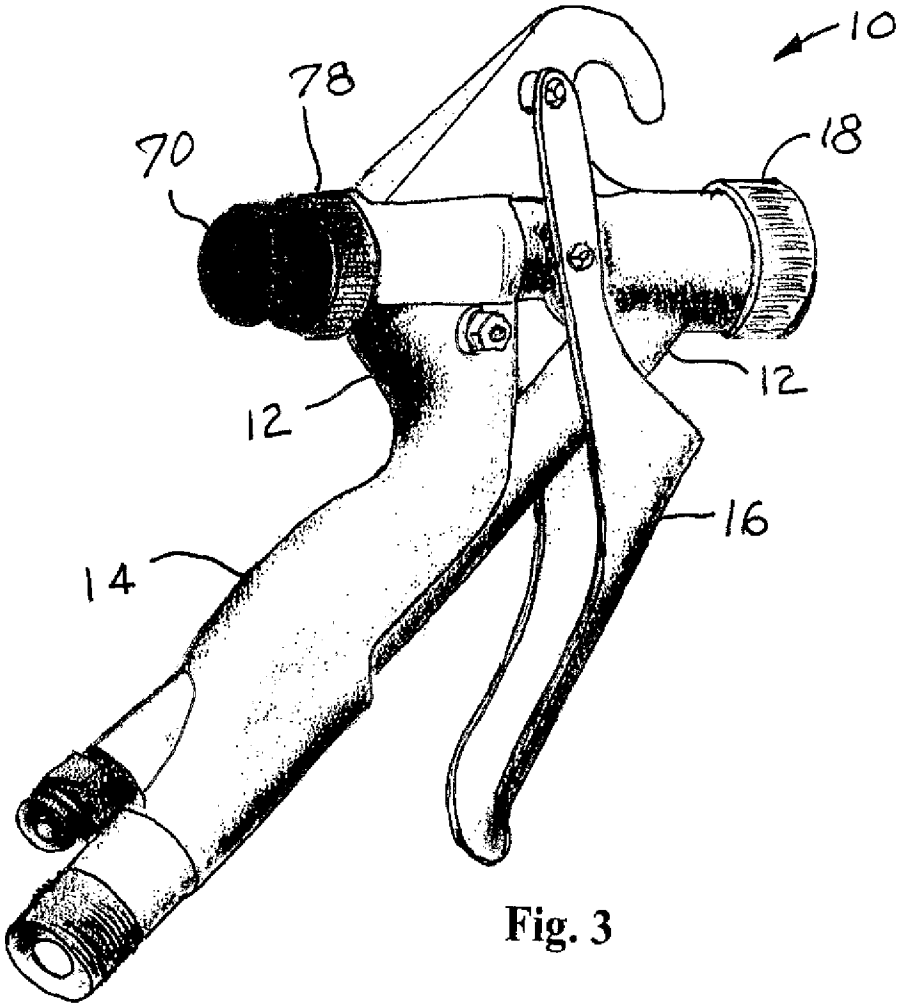
FIG. 3 is a third perspective view from the right side and to the rear of the texture gun of FIG. 1.

Referring now to the Figures, and most particularly to FIGS. 1-14, a first embodiment of the texture gun of the present invention may be seen. The spray gun of the present invention may be set up as a non-air bleed configuration or an air bleed configuration. In a non-air bleed (or "non-bleeder") configuration, air used to propel the texture mixture is turned at least substantially all the way OFF when the gun is not triggered, i.e., when the trigger is not pulled by a user to discharge texture material. In an air bleed (or "bleeder") substantial air flow continuously exits the front of the gun at the texture nozzle regardless of the position or activation of the trigger; in such a configuration, air is continuously ON at the level used to propel texture material, whether the texture material is being discharged or not. In other words, in the non-bleeder configuration, the trigger turns ON both the air flow and texture material flow. In the bleeder configuration, air flow is always ON, and the trigger turns ON only texture material flow.

Regardless of the air flow configuration to which the spray gun is set up, the texture material supplied to the spray gun will not be released until the spray gun main shaft travels at least 0.090". If the spray gun is configured to be non-bleed, air will bleed through the air nozzle of the spray gun immediately upon trigger actuation and will be joined by texture material only after the main shaft has traveled at least 0.090". Material flow is controlled by degree of trigger actuation which controls how far the main shaft travels towards the rear of the spray gun. As the shaft travels rearward, material flow increases. The material flow adjustment knob on the rear of the spray gun body limits the trigger movement and shaft travel from minimum to maximum with continuously adjustable settings in between. When the desired flow adjustment is achieved, the knob can be locked in place to prevent accidental movement of the adjustment knob.

Air flow can also be controlled within the spray gun body via the rotation of the air flow control valve which is located perpendicular to the air passage port within the spray gun handle. Rotation of the valve knob either increases or decreases the flow of air from full "on" to either: i) full "off" (in the first embodiment) or to ii) a "minimum" air flow (in the second embodiment) with continuously adjustable settings in between. The air flow control valve knob is attached to an air valve shaft which perpendicularly intersects the main air passage port. At the point of intersection is a hole in the air valve shaft, which, based on the rotation of the knob, exposes the hole in varying degrees to the air passage port of the spray gun, thus controlling the air flow through the gun head to the air nozzle. In this aspect of the present invention, an integrated air valve is provided on the texture spray gun, unlike typical prior art texture spray guns.

The spray gun handle houses both the material and air flow passage ports unlike prior art texture spray guns which typically have (at most) only the air passage port running through the handle while the material passage port is (typically) forward of the gun trigger. With the material passage forward of the spray gun trigger, the user must "fight" the weight of the material hose, filled with texture material, because it is cantilevered out away from the user's hand, thus increasing hand and arm strain.

This strain is reduced in the practice of the present invention where the material passage runs through the ergonomically designed spray gun handle which is grasped in the palm of a user during operation.

Referring to the Figures, and most particularly to FIGS. 1-5, the gun 10 has a gun body 12 preferably formed of aluminum. Gun body 12 has a handle 14 and a trigger 16. A nozzle nut 18 is threadably secured to the front of the gun body 12 and retains a texture nozzle 20 to the gun body 12. An air valve 22 is located in gun body 12. The air valve has an air valve knob 24 on an air valve shaft 26, aspects of which may be seen in FIGS. 7 and 14.

Figure 6:
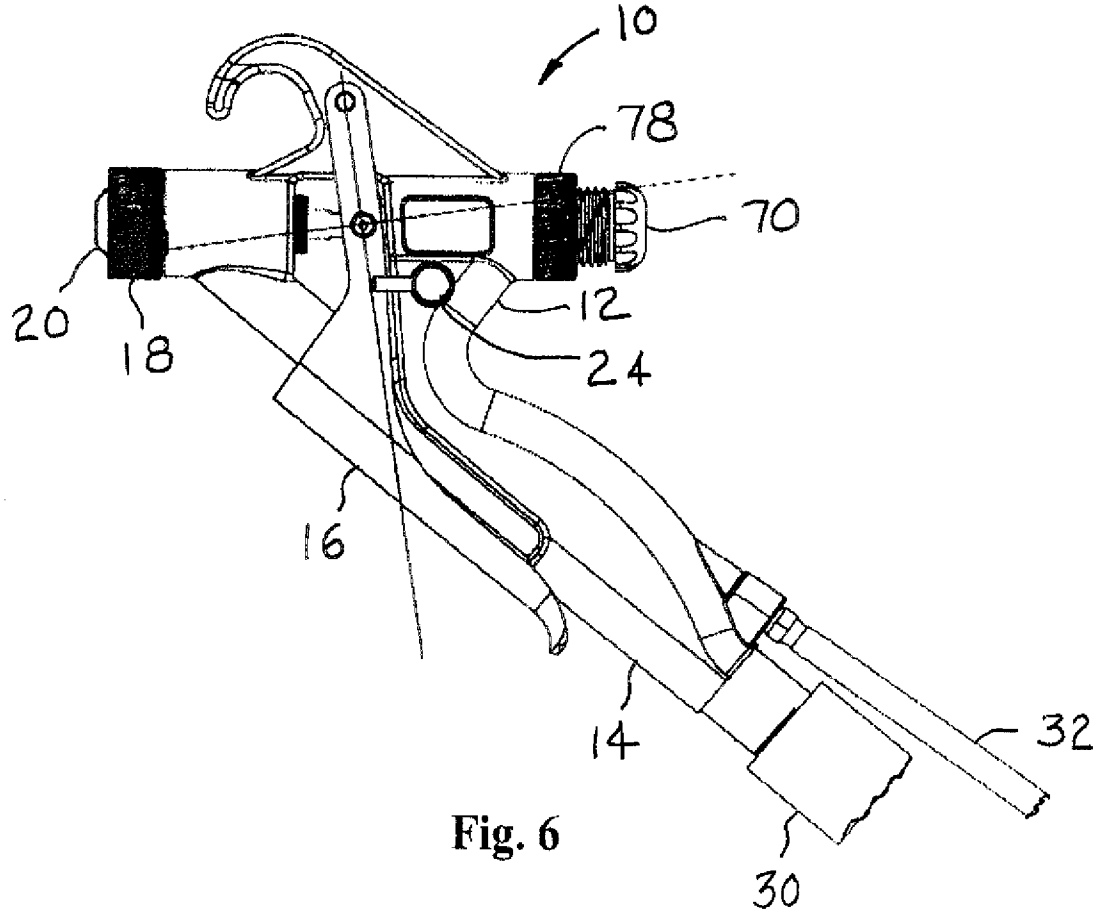
FIG. 6 is a view similar to that of FIG. 5, except with the trigger in a fully depressed condition.
Figure 7:
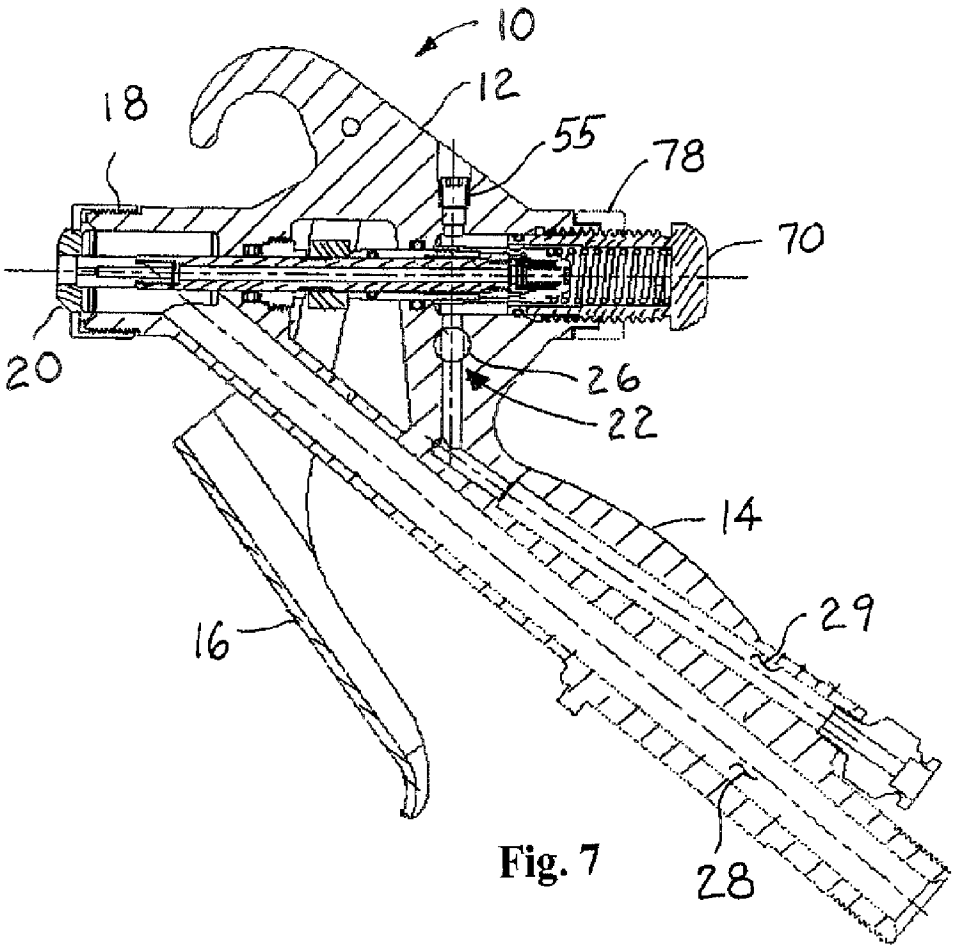
FIG. 7 is a section view along line VII-VII of FIG. 4.

Referring now also to FIGS. 6 and 7, more details of the texture nozzle 20 and other parts of the gun 10 may be seen. Gun 10 has a texture material passageway or port 28 and an air passageway or port 29. Texture port 28 may be connected via a texture hose 30 to a supply of texture material (not shown), and air port 29 may be connected via an air hose 32 to a source of compressed air (not shown).

Figure 8:
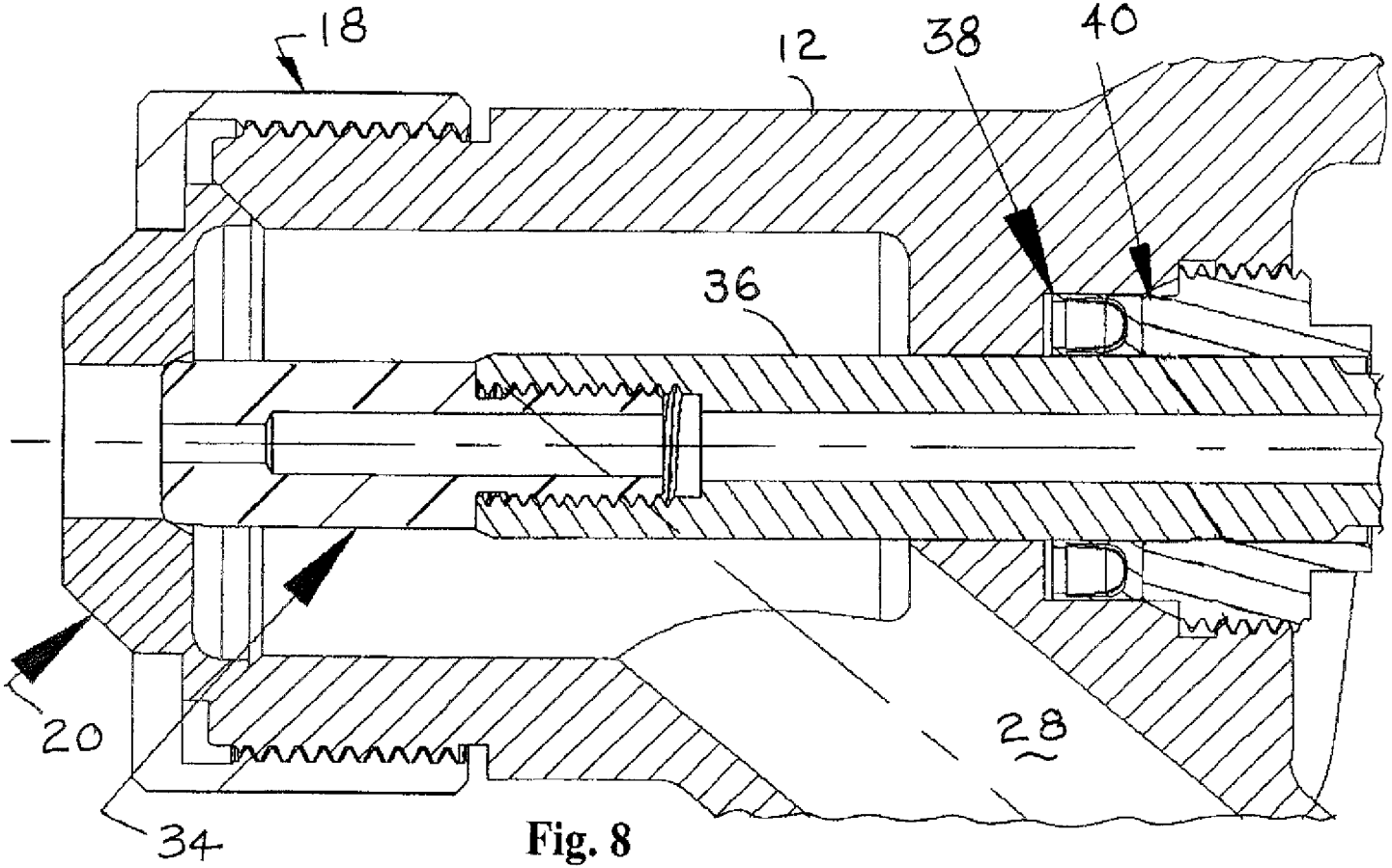
FIG. 8 is an enlarged view of a front portion of the gun of FIG. 7.
Figure 9:
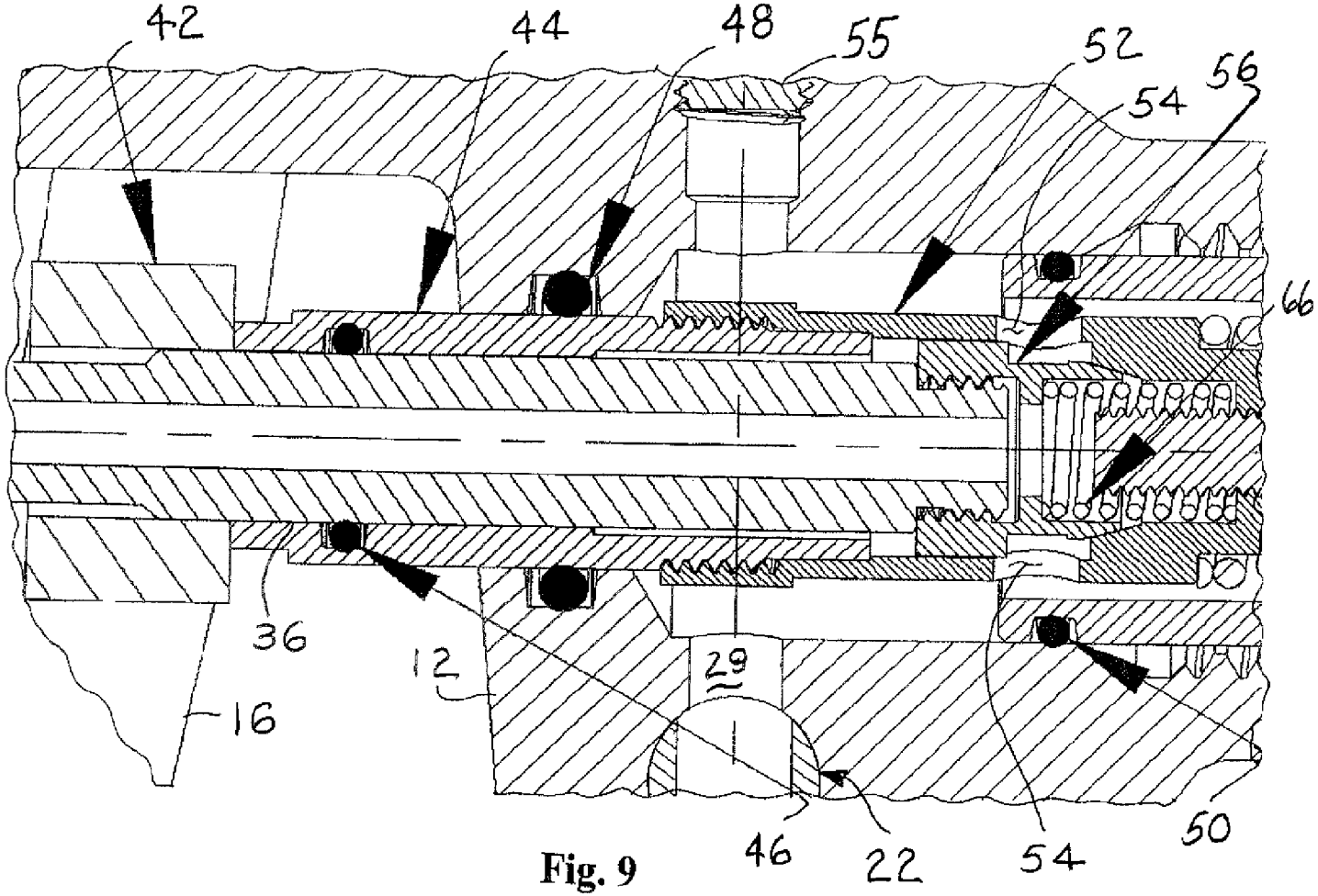
FIG. 9 is an enlarged view of a middle portion of the gun of FIG. 7.
Figure 10:
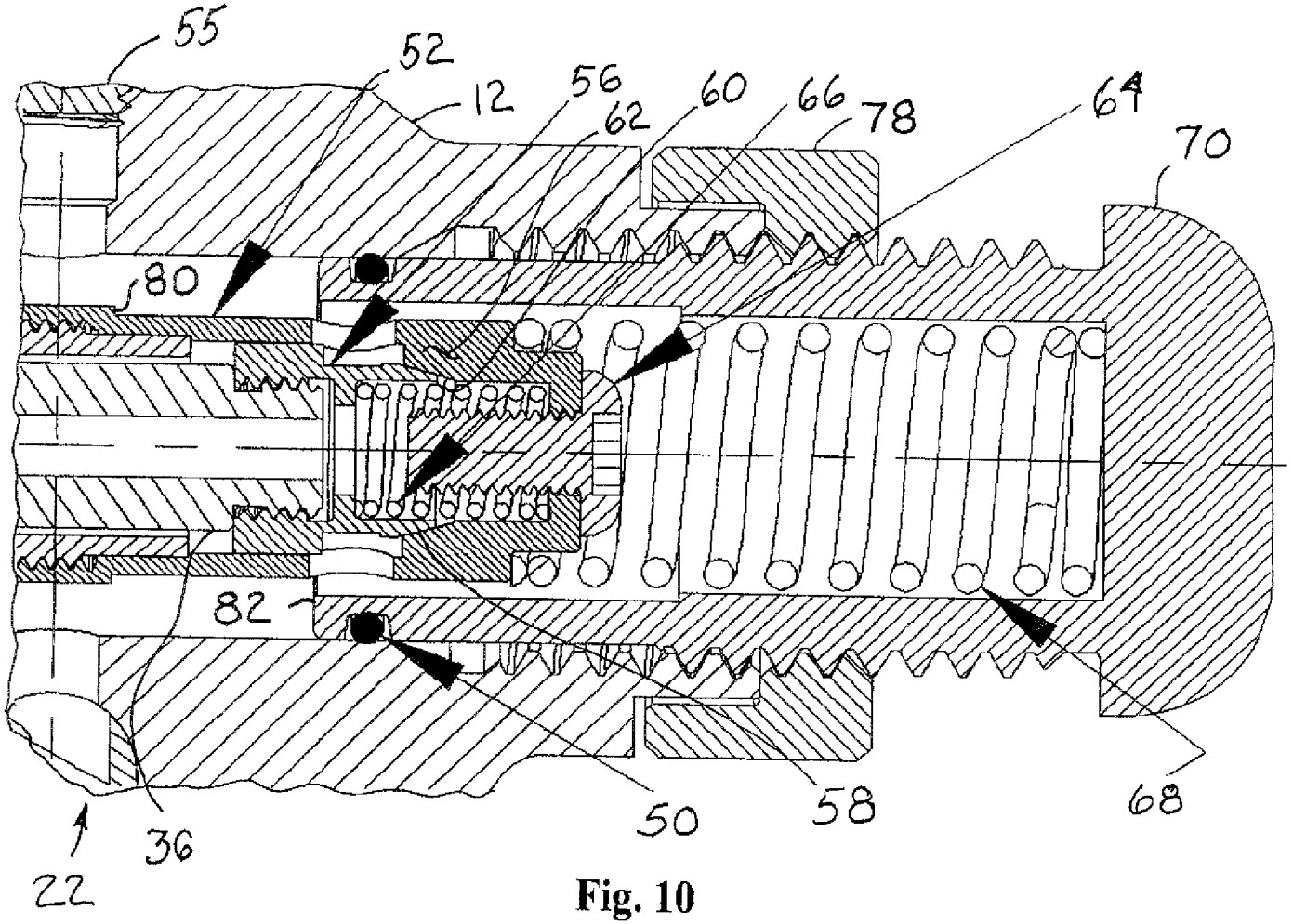
FIG. 10 is an enlarged view of a rear portion of the gun of FIG. 7.

Referring now also to FIGS. 8, 9, and 10 various details of the texture gun 10 may be seen. Gun 10 has an air nozzle 34 threaded to a front end of a texture shaft 36. Texture shaft is sealed to gun body 12 via an energized or non-energized U cup seal 38 which is retained by a retainer screw 40 threaded into gun body 12. A trigger attachment 42 couples motion of the trigger 16 to an air trip rod 44 when the trigger is pulled or depressed. 0-rings 46, 48 and 50 seal the parts against which they are positioned within the gun. A shut off valve 52 is threaded onto the air trip rod 44. Shut off valve 52 has diametral apertures 54 in fluid communication with air port 29. Air port 29 is sealed by a plug 55. An air valve seal 56 is threaded onto a rear portion of the texture shaft 36. The air valve seal 56 has an external cone shaped surface 58 which mates with to seal against an internal cone shaped surface 60 serving as an air valve seat 62 formed on the shut off valve 52. A screw 64 closes an end of the air valve seat portion of the shut off valve 52. A first spring 66 is located between the air valve seal 56 and the air valve seat portion 62 of the shut off valve 52 and provides a separating force between these two parts when the trigger 16 is depressed, moving the air trip rod 44 and shut off valve 52 rearwardly. A second spring 68 acts against the texture adjustment knob 70 and urges the shut off valve 52 closed when the trigger 16 is released. The air nozzle 34 acts as a mechanical barrier to prevent the flow of texture material from the texture passageway 28 to the texture nozzle 20 when the trigger 16 is released, as shown in FIG. 8. Texture adjustment knob 70 may be threaded in or out of the gun body 12 to set the maximum opening for the texture material path or port 28 by limiting the maximum rearward travel of the texture shaft 36 in response to an operator pulling the trigger 16. The setting of knob 70 (and the consequent maximum flow of texture material) may be locked by tightening a texture knob lock nut 78 against the gun body 12. It is to be understood that a shoulder 80 on the shut off valve 52 will contact a forward face 82 of the knob 70 to limit rearward travel of the texture shaft 36, as may be seen most clearly with these features 80 and 82 separated in FIG. 10 (material flow OFF) and in contact in FIG. 12 (material flow full ON).

Figure 5:
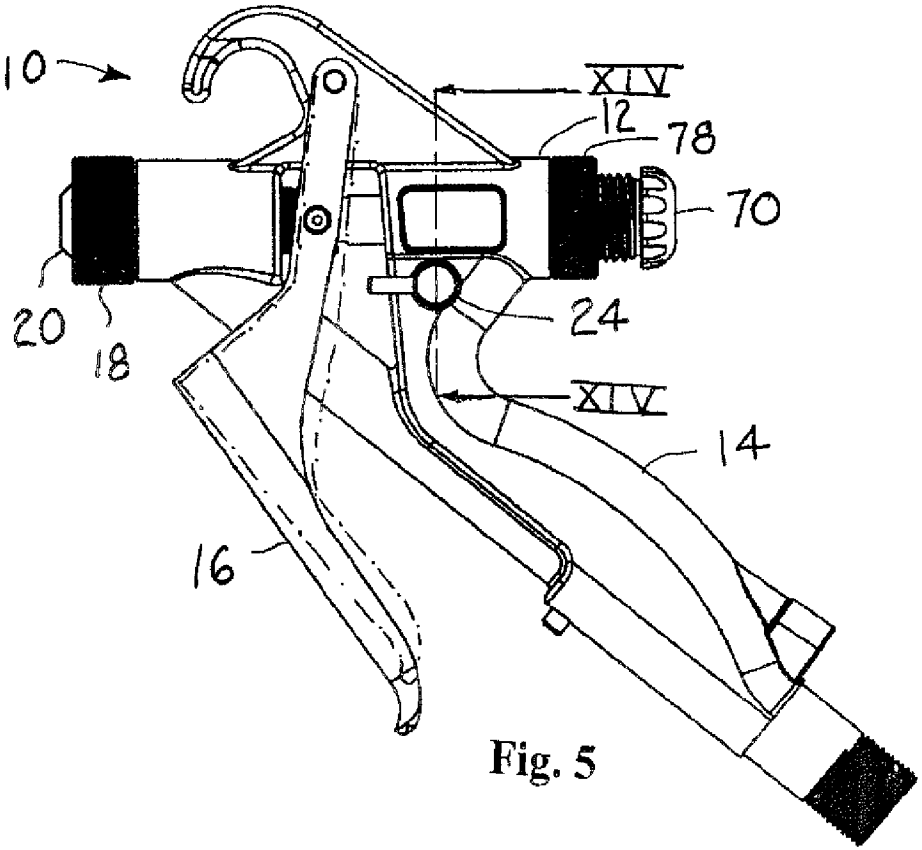
FIG. 5 is a left side elevation view of the texture gun of FIG. 1 showing a trigger in a released position in solid lines and a partially depressed condition in chain lines.
Figure 4:
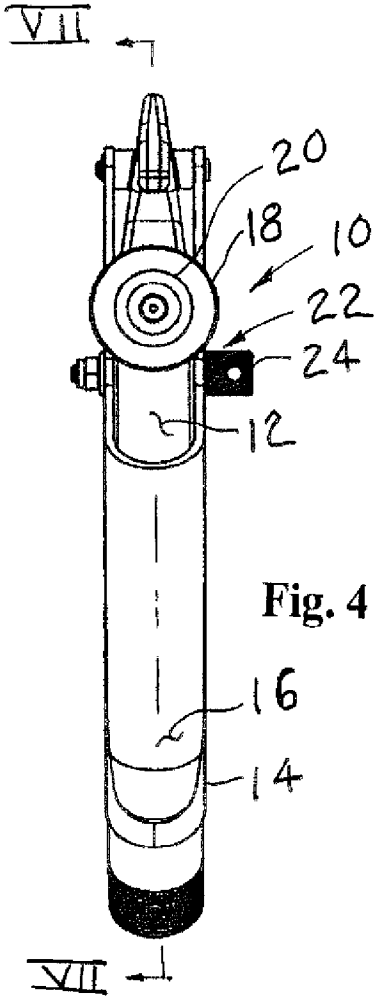
FIG. 4 is a front elevation view of the texture gun of FIG. 1.
Figure 11:
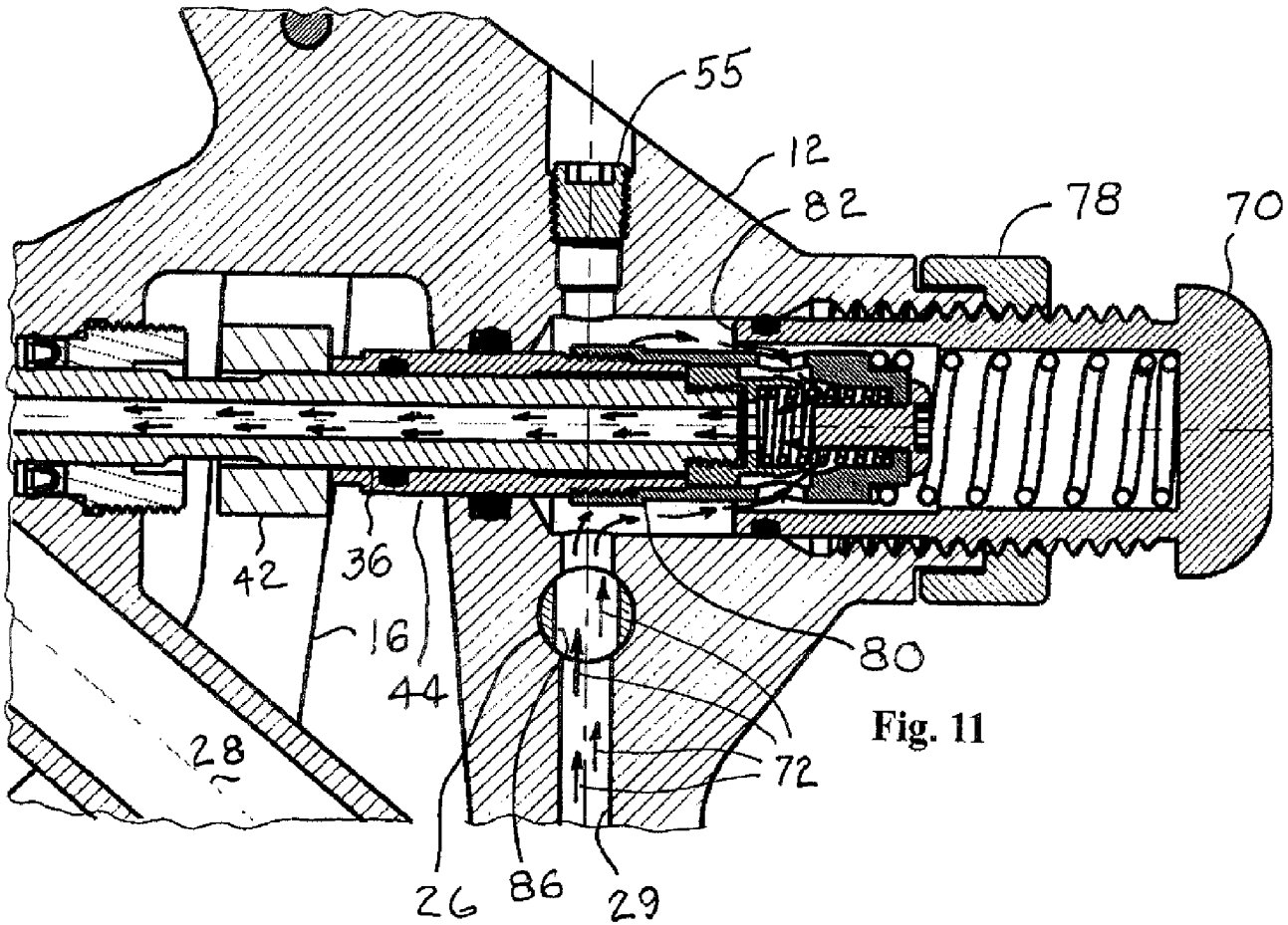
FIG. 11 is an enlarged view similar to that of FIG. 10, except with parts shown corresponding to the partially depressed trigger condition of FIG. 5.
Figure 12:
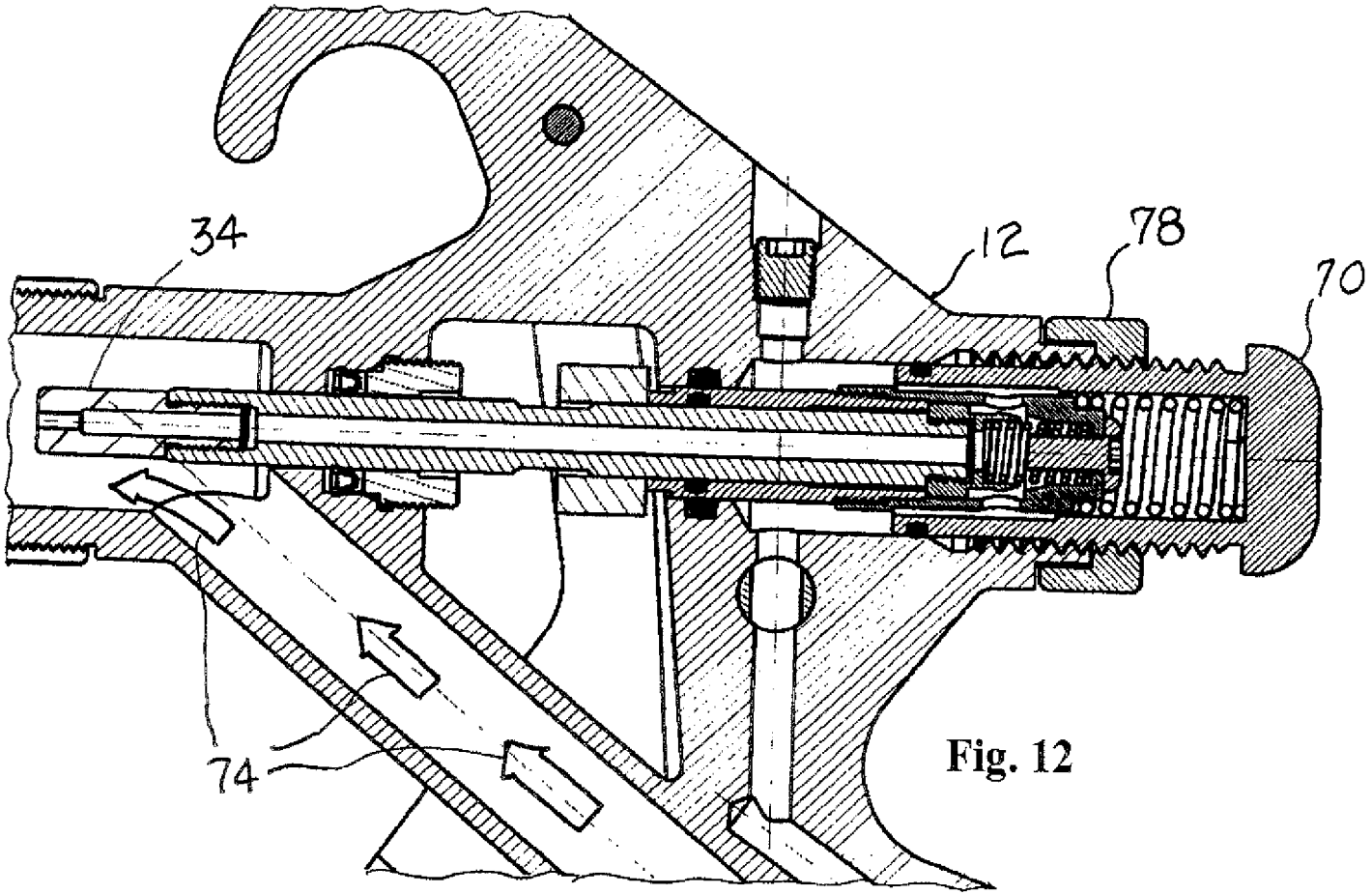
FIG. 12 is an enlarged view similar to that of FIG. 10, except with parts shown corresponding to the fully depressed trigger condition of FIG. 6.
Figure 13:
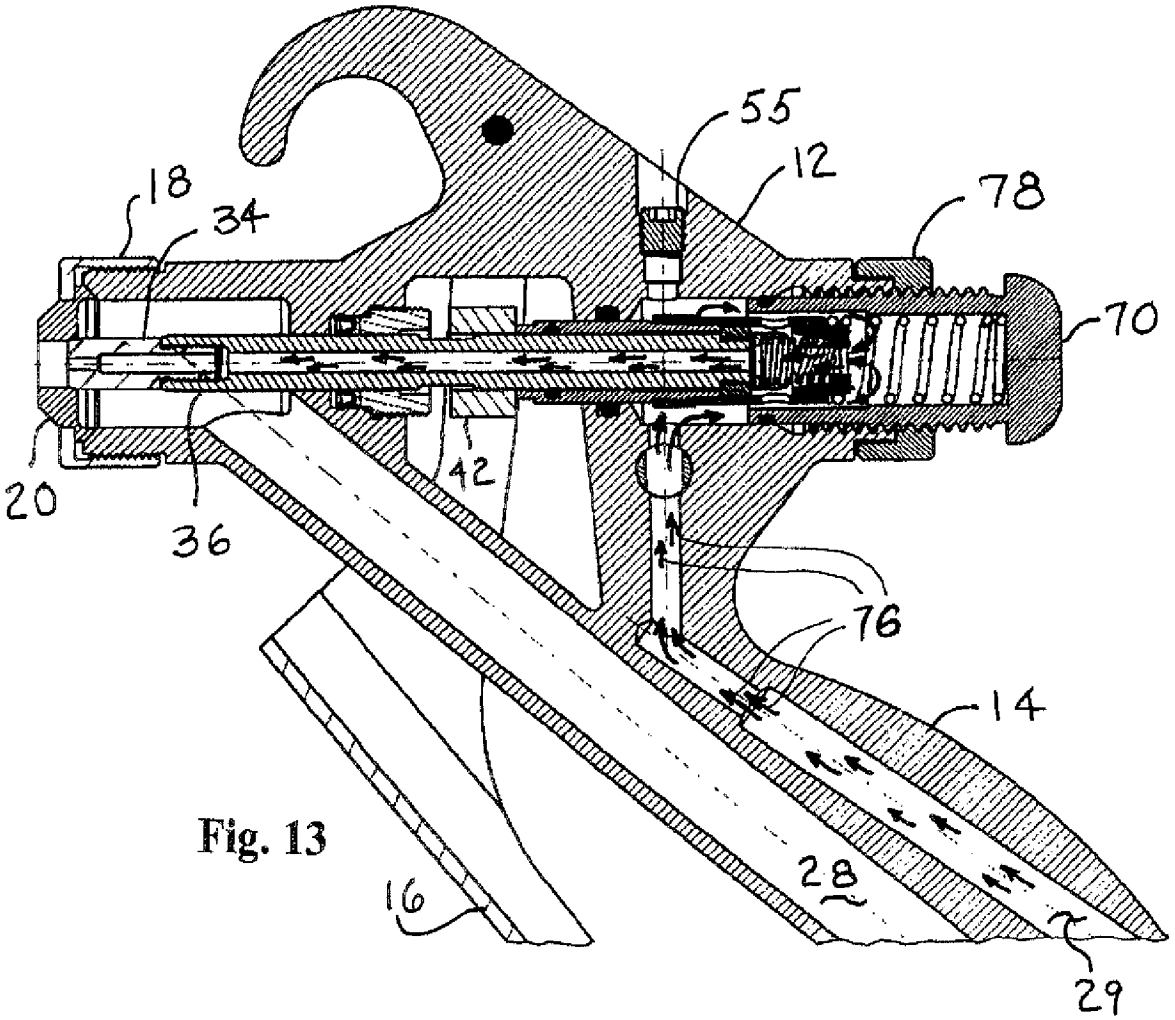
FIG. 13 is a view of the rear portion of the gun corresponding to that shown in FIG. 10, except with a screw removed for "bleeder" type operation.

With the trigger 16 released, both the texture port 28 and the air port 29 are shut off (provided screw 64 is installed). Referring now to FIGS. 5 and 11, when the trigger 16 is moved from the position shown in solid lines in FIG. 5, to the position shown in chain (dash dot) lines, the shut off valve 52 is opened, allowing air to flow as indicated by arrows 72 in FIG. 11. It is to be understood that air will continue to flow as the trigger is fully depressed, as shown in FIG. 6, at which time texture material will be allowed to flow (as indicated in FIG. 12 by arrows 74), because the air nozzle is retracted from the texture nozzle.

The above operation describes the gun 10 in a non-bleeder type operation where the air is bled only when the trigger is depressed. Gun 10 can be converted to a full time bleeder operation by removing screw 64, after which air will flow as indicated by arrows regardless of whether the trigger 16 is pulled or not. In this aspect of the present invention, gun 10 is thus seen to be easily convertible between non-bleeder and bleeder operation by the presence or absence of screw 64, once the texture adjustment knob is removed, giving access to the screw 64.

Figure 14:
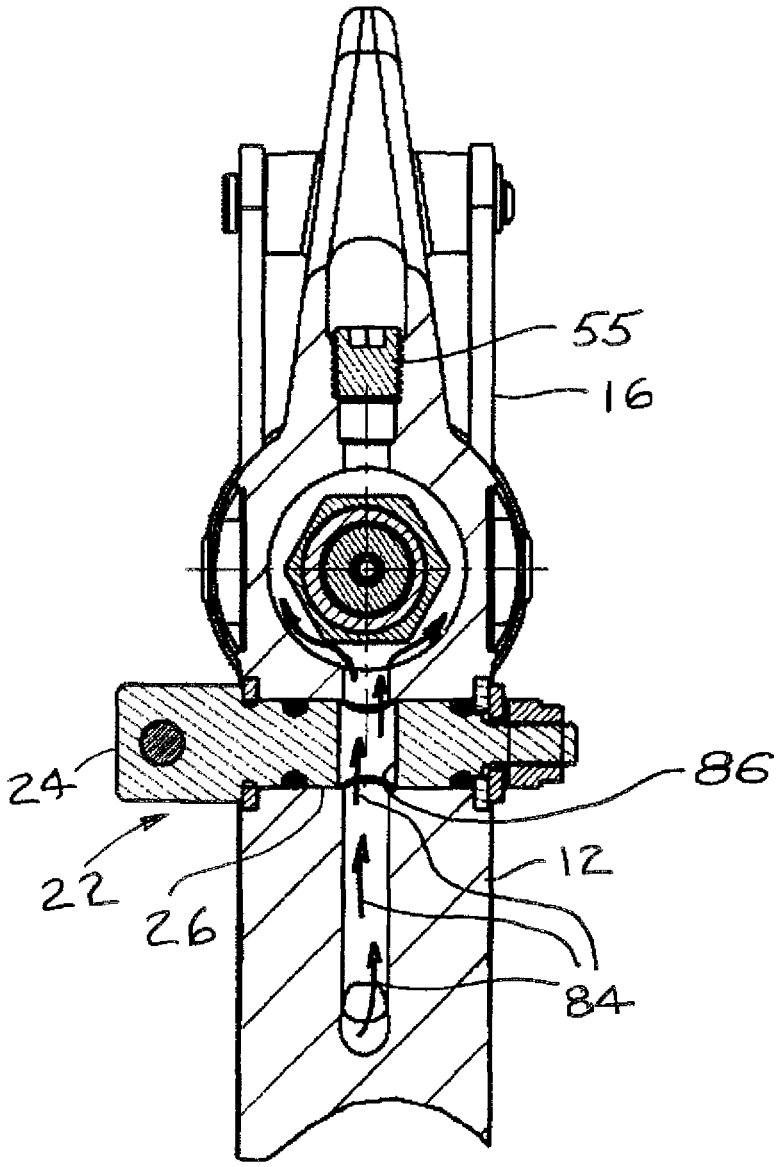
FIG. 14 is a section view taken along line XIV-XIV of FIG. 5.
Figure 15:
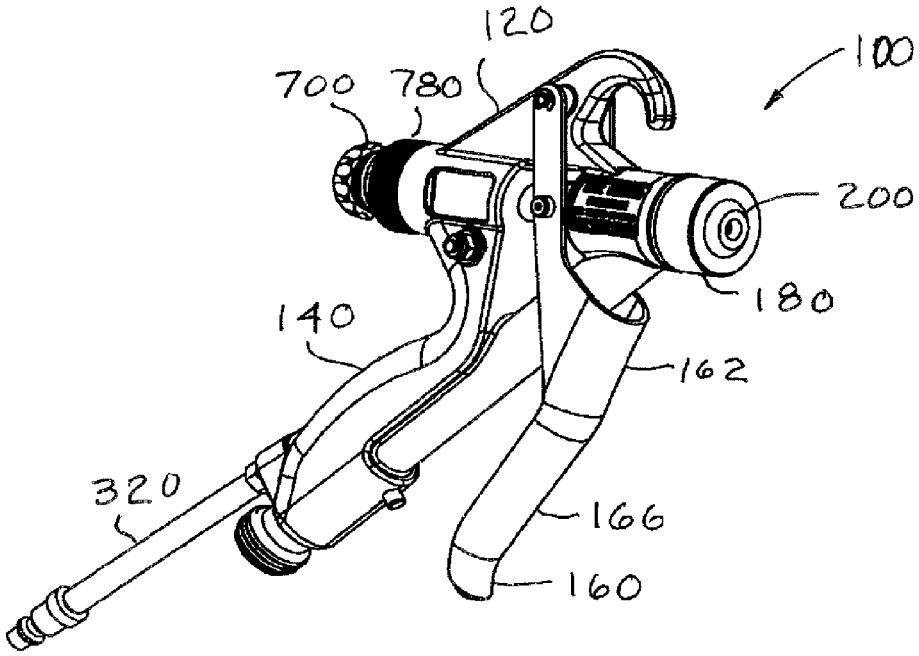
FIG. 15 is a first perspective view, similar to that of FIG. 1, except of an alternative embodiment of a texture gun useful in the practice of the present invention.
Figure 16:
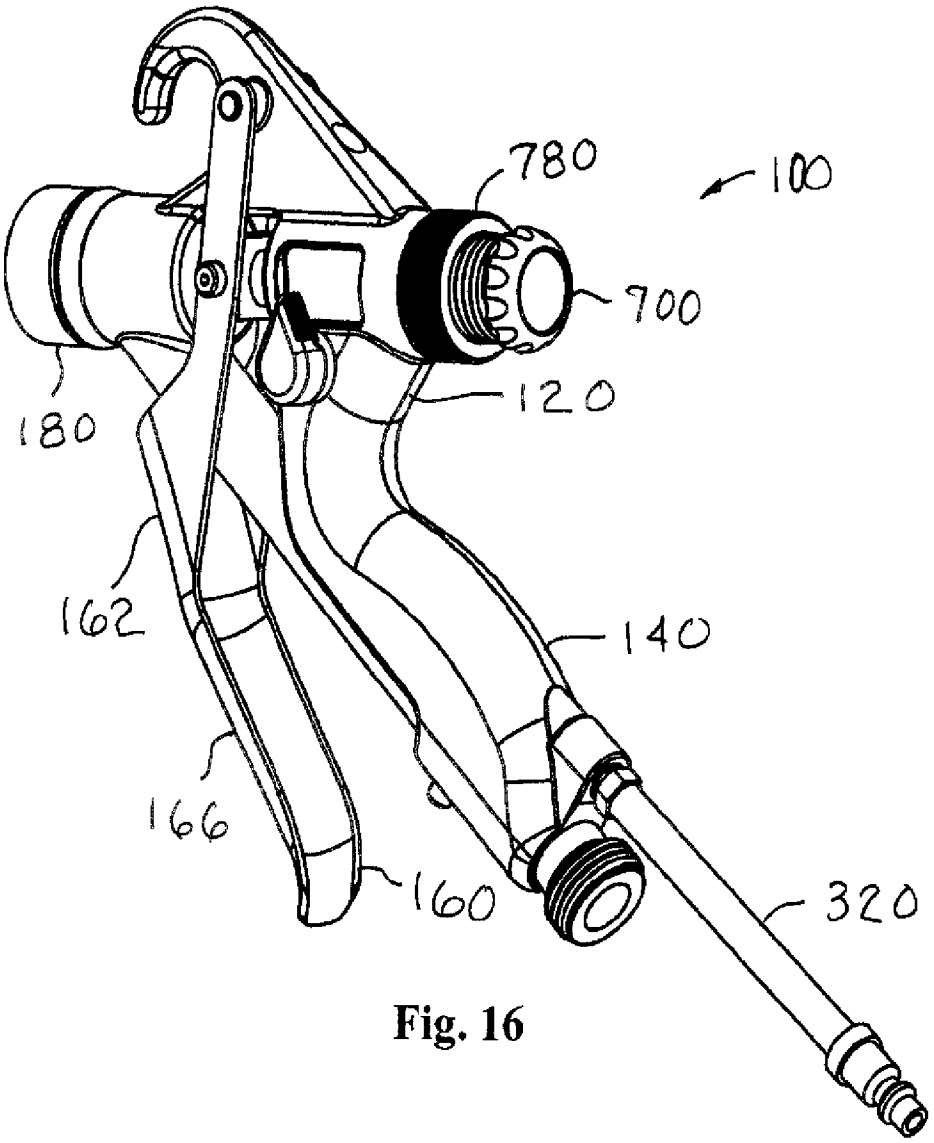
FIG. 16 is a second perspective view, similar to that of FIG. 2, except of the texture gun of FIG. 15.
Figure 17:
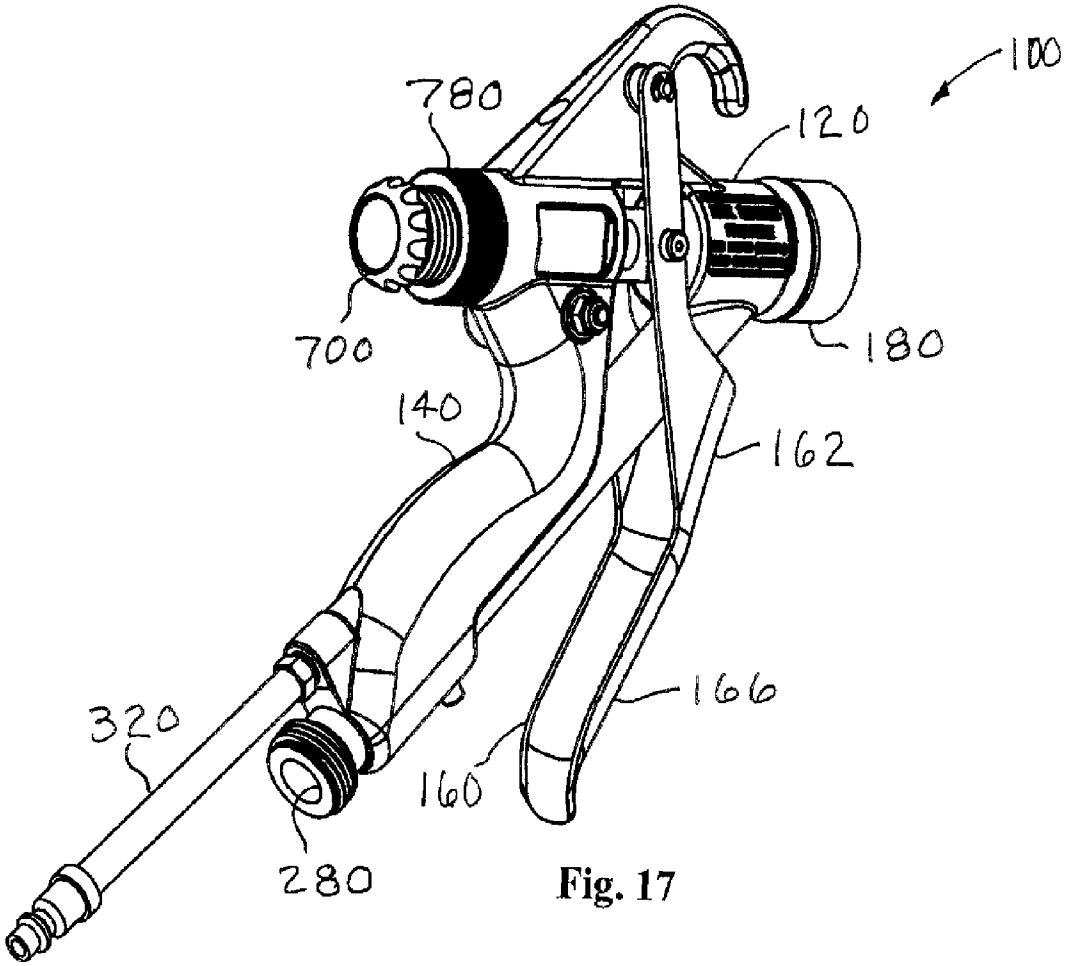
FIG. 17 is a third perspective view, similar to that of FIG. 3, except of the texture gun of FIG. 15.
Figure 18:
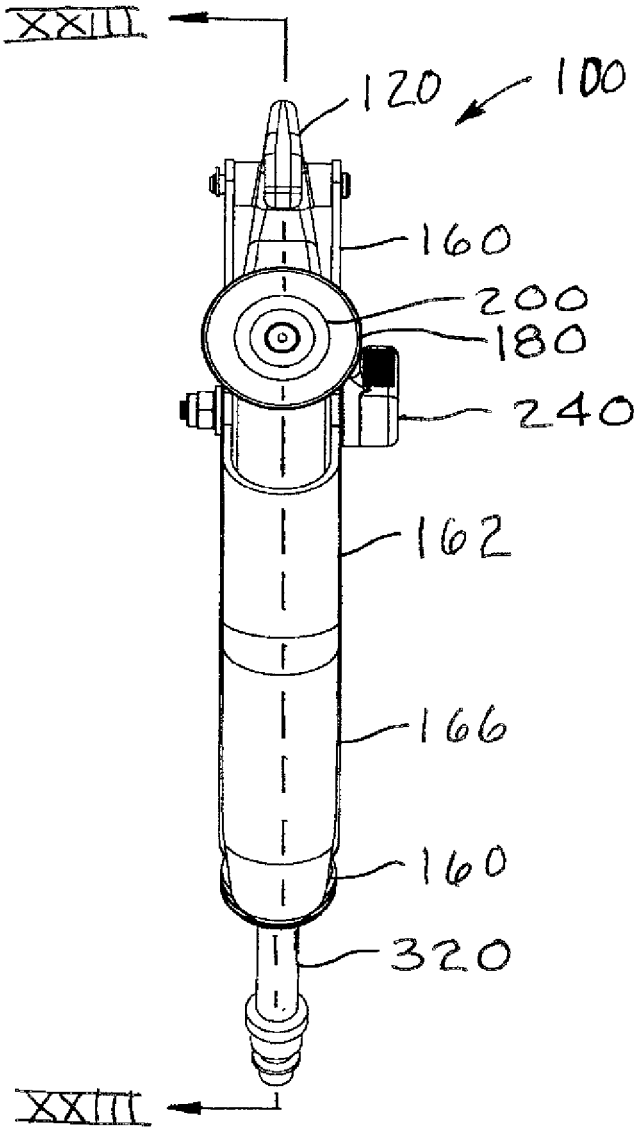
FIG. 18 is a front elevation view of the texture gun of FIG. 15.
Figure 19:
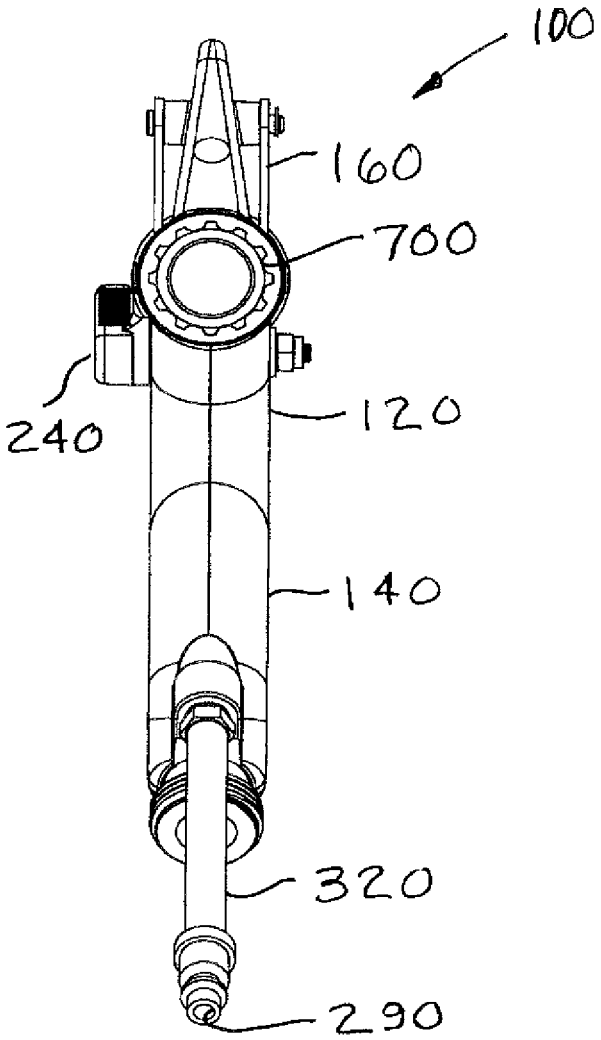
FIG. 19 is a rear elevation view of the texture gun of FIG. 15.
Figure 20:
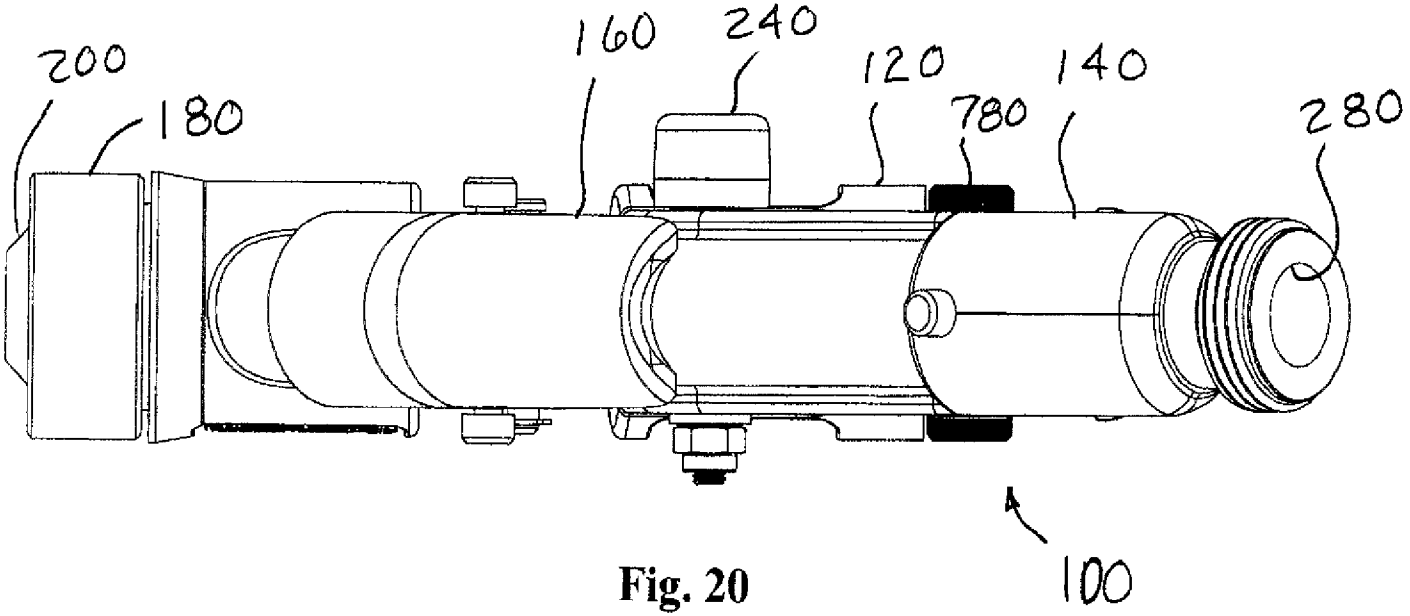
FIG. 20 is a bottom plan view of the texture gun of FIG. 15.
Figure 21:
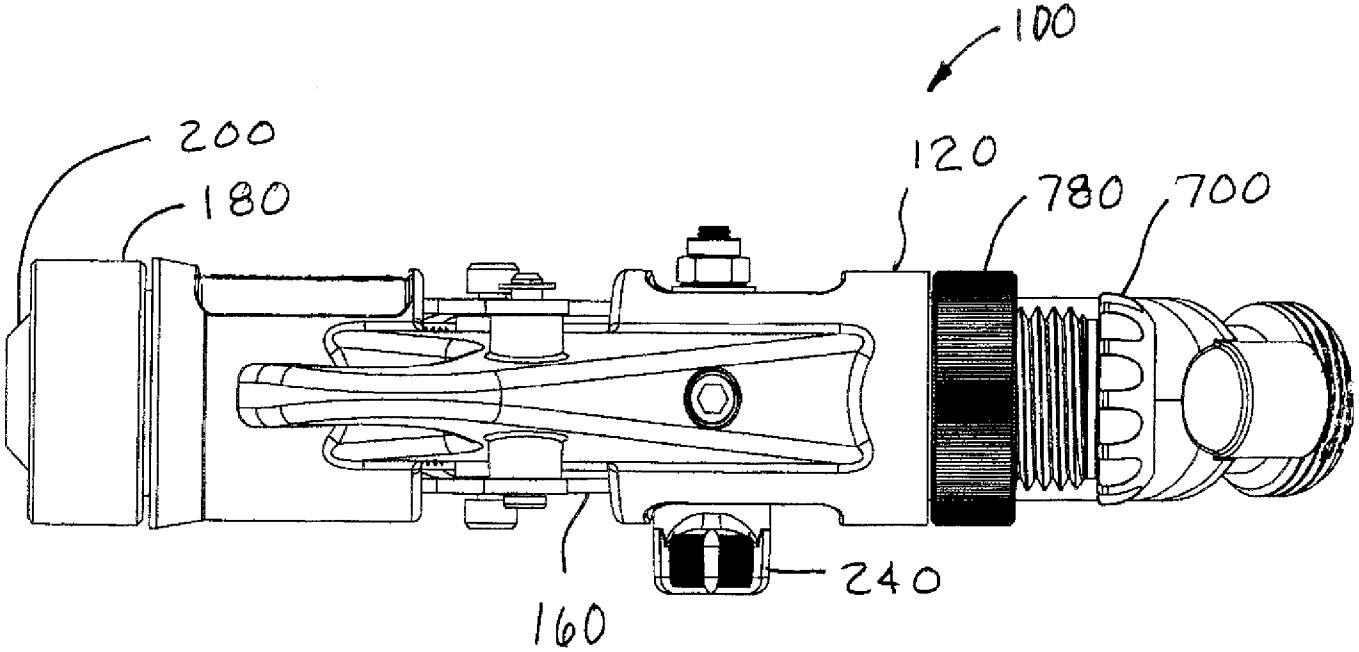
FIG. 21 is a top plan view of the texture gun of FIG. 15, except with an air hose extension removed.
Figure 22:
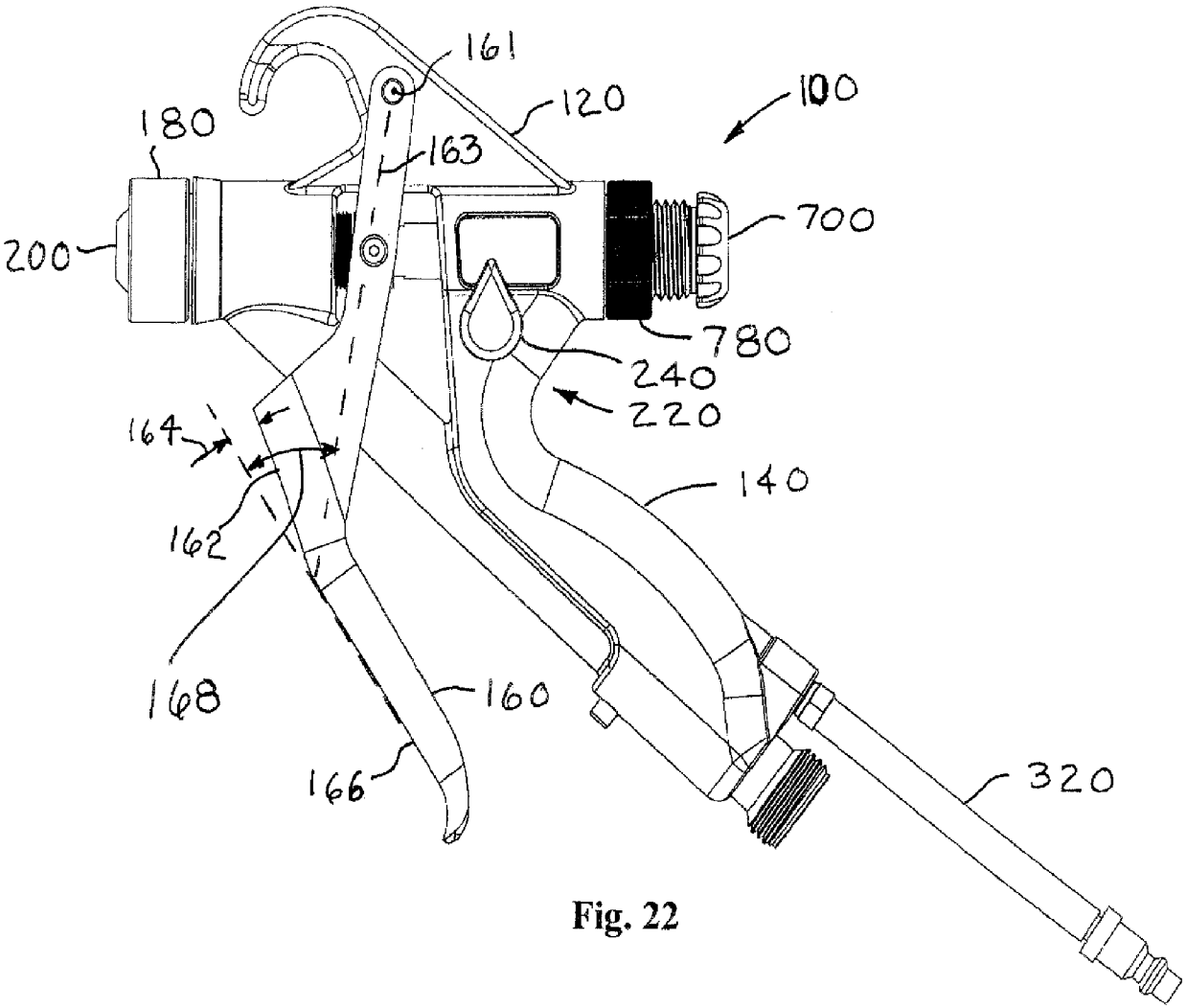
FIG. 22 is a left side elevation view of the texture gun of FIG. 15 showing the trigger in a released position.

Referring now to FIG. 14, a section view of the gun 10 along line XIV-XIV of FIG. 5 may be seen. This view illustrates certain aspects of the air flow indicated by arrows 84 through the air passageway 29 and through a main transverse passage 86 in the shaft 26 of the air valve 22, with the valve in a fully open condition, corresponding to that shown in FIG. 11. The air valve 22 may be used to control the flow of air used to propel the texture material by partially closing the air passageway 29 using the knob 24 to rotate shaft 26 to partially or fully block passageway 29.

Referring now to FIGS. 15-25, the texture gun may be seen in a second embodiment 110. In this embodiment, the same or similar parts and features are identified by the same reference numerals, except multiplied by 10 from the reference numerals associated with the first embodiment described supra. Additional or different parts or features have reference numerals in the new series without necessarily having corresponding reference numerals associated with the first embodiment.

In FIGS. 15-22, various external views of the texture gun 100 may be seen. Texture gun 100 has a gun body 120 and handle 140, each of which may be the same as for the gun 10. Texture gun 100 has a trigger 160 that differs from trigger 16 in that trigger 160 has an upper portion 162 formed at an angle 164 (see FIG. 22) to a lower portion 166, in contrast to the trigger 10 which is formed with a straight gripping section. The angle 164 may be 12 degrees to improve the ergonomics of the trigger 160, making it easier and more comfortable for a user to grasp. Trigger 160, like trigger 16 is connected to the gun by a pivot 161 and has a pivot radius 163. The distal section 166 of the trigger 160 forms a first angle 168 with respect to the pivot radius 163, while the proximal section 162 forms a second angle which is the difference between angles 162 and 164 with respect to the pivot radius 163. The first angle 168 may be about 44 degrees, while the second angle may be about 32 degrees.

Figure 23:
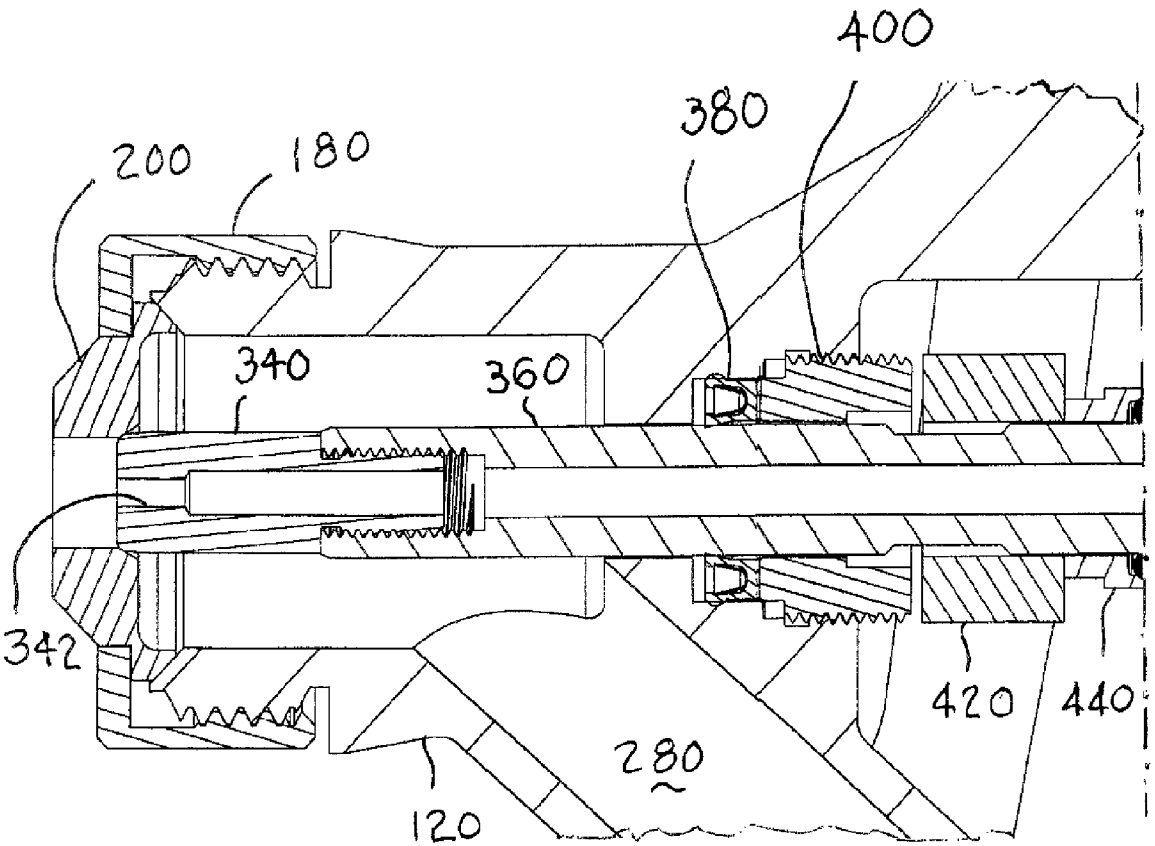
FIG. 23 is a section view of a front portion of the texture gun of FIG. 15, taken along line XXIII-XXIII of FIG. 18.
Figure 24:
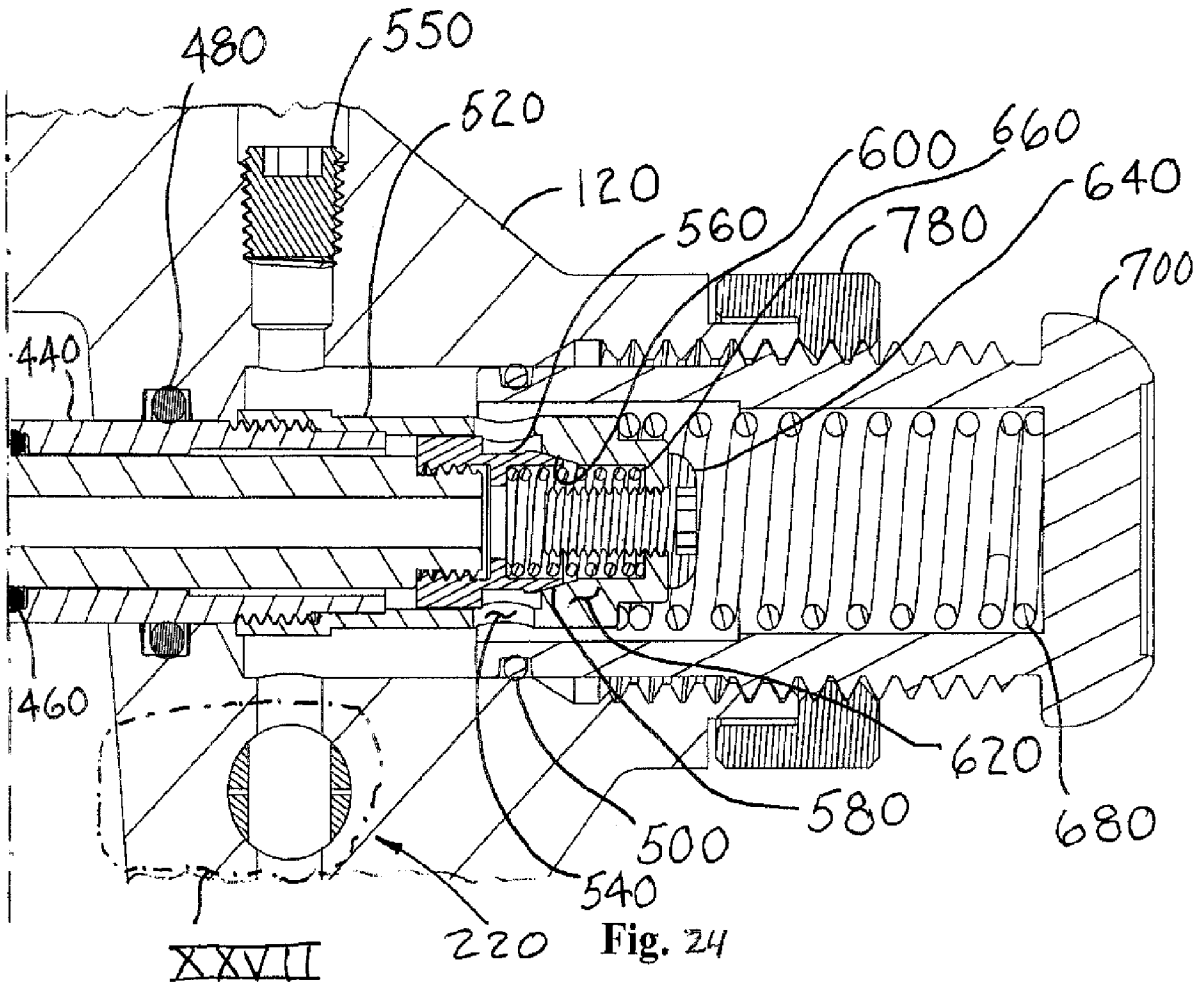
FIG. 24 is a section view of a rear portion of the texture gun of FIG. 15, taken along line XXIII-XXIII of FIG. 18.
Figure 25:
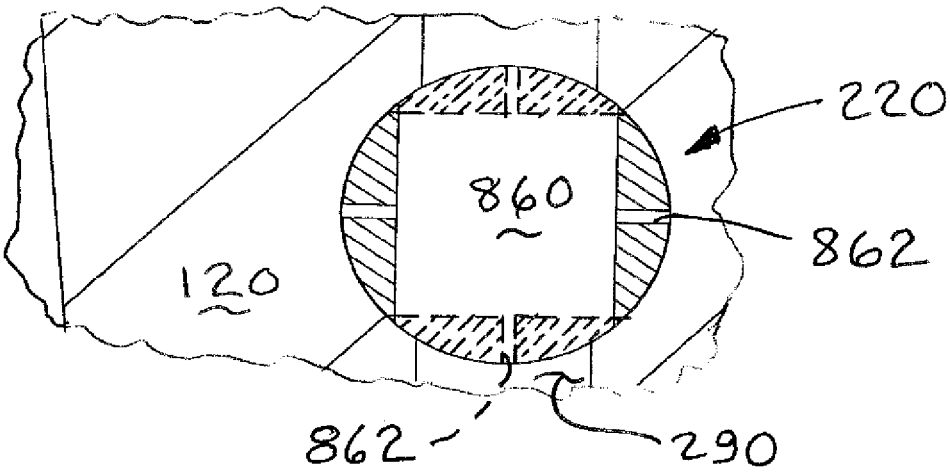
FIG. 25 is a still further enlarged view of detail XXVII of FIG. 24.

Gun 100 also has a nozzle nut 180 to retain a nozzle 200 and an air valve 220. Gun 110 also has an air valve knob 240 and a texture adjustment knob 700, along with a texture knob lock nut 780. Gun 100 also has a texture material passageway 280 and an air passageway 290. Referring now also to FIGS. 23-25, gun 100 has an air valve shaft similar to shaft 26 and a plug 550 to close the top end of the air passageway 290.

Referring now to FIGS. 23 and 24, gun 100 has an air nozzle 340 mounted on a texture shaft 360, and a U-cup seal 380 to prevent leakage along the shaft 360 and retainer screw 400 to hold the seal 380 in position as the shaft moves axially during operation of the gun 100. Gun 100 also has a trigger attachment 420, an air trip rod 440, and three 0-rings, 460, 480 and 500 to seal against air leakage. Pulling trigger 160 will move the trigger attachment 420 rearward, moving the air trip rod 440 rearward by a distance of at least 0.090 inches until contact is made between the air trip rod 440 and an air valve seal member 560. As the air trip rod 440 moves back and before contact is made with the air valve seal 560, an air valve seat 620 is moved rearward, separating internal cone shaped surface 600 on the air valve seat 620 from the external cone shaped surface 580 on the air valve seal 560. This separation opens the air flow path from air passageway 290 to the air nozzle 340. Once contact is made between the air trip rod 440 and the air valve seal 560 and rearward motion continues, the texture shaft 360 will be moved rearward, separating the air nozzle from the texture nozzle 200 and allowing texture material to flow from the texture material passageway 280 out through the texture nozzle, as propelled by the air exiting a central bore 342 in air nozzle 340.

As in the first embodiment, a screw 640 may be removed to convert gun 100 to "bleeder" operation in which air flows continuously from air passageway 290 through the air nozzle bore 342, regardless of the position of the trigger 160 and air valve seal 560. Spring 660 operates to ensure separation of the cone shaped surfaces 580 and 600 when the trigger is moved rearward moving the air trip rod 440 into engagement with the air valve seal 560. Spring 680 biases the various air and texture parts to a closed position when the trigger 160 is released, shutting off the flow of texture material from passageway 280.

Unlike the first embodiment, air flow cannot be completely blocked in gun 100 since there is a secondary transverse passage 862 in addition to a primary transverse passage 820 in shaft 26, which may be seen most clearly in FIG. 25. Two positions are shown for the shaft in FIG. 25. The solid lines show a full ON position wherein full airflow is permitted through passageway 860 from air passageway 290. The dashed lines show a minimum air flow condition wherein only a small amount of air is permitted to flow through secondary passageway 862 from air passageway 290. As stated above, the minimum air flow prevents texture material from entering the bore 342 when the knob 240 is turned to the lowest air flow setting.

The invention is not to be taken as limited to all the details thereof as modifications and variations thereof may be made without departing from the spirit or scope of the invention. For example and not by way of limitation, the minimum air flow feature may be provided by a rotational stop on the shaft of the air valve to limit movement to prevent fully closing the primary or main transverse passage, as an alternative to having a secondary passage in the air valve shaft.

What is claimed is:

1. A texture spray gun for applying semi-solid slurry material to a surface to be coated, the gun comprising:

a gun body having a handle;

an air passageway in the gun body, wherein the air passageway comprises a selectively removable screw configured to convert the texture spray gun between a non-air bleed configuration and an air bleed configuration;

a texture nozzle secured to the gun body and configured to support discharge of the semi-solid slurry material from the gun at a texture discharge opening;

a texture material passageway in the gun body, the texture material passageway configured to support the flow of the semi-solid slurry material to the texture nozzle, and wherein a texture shaft is moveably positioned within the texture material passageway and wherein the texture material passageway is configured to prevent release of the semi-solid slurry material until the texture shaft and attached air nozzle have traveled beyond a minimum distance, and wherein a texture adjustment knob is configured to control a maximum rearward travel distance of the texture shaft; and a trigger movably attached to the gun body for selectively forming a mechanical barrier in a path from the texture passageway to the texture nozzle, to control the discharge of the semi-solid slurry material from the gun; wherein the mechanical barrier is selectively formed as the air nozzle contacts the texture nozzle; wherein the texture material passageway is located in and passes through the handle of the gun body and the air passageway is in fluid communication with the texture passageway upstream of the texture discharge opening such that air exiting the air passageway propels the semi-solid slurry material from the gun when the trigger opens the mechanical barrier in the path of the texture passageway.

2. The texture spray gun of claim 1, wherein at least a portion of the air passageway is located in and passes through the handle of the gun body, and the gun further comprises an air valve fluidly connected with the air passageway to control the flow of air through the gun.

3. The texture spray gun of claim 1, further comprising an air valve adjustable from a fully open condition to no less than a minimum air flow condition with the air flow greater than zero.

4. The texture spray gun of claim 3, wherein the air valve comprises a main transverse passage in a shaft projecting across the air passageway and the improvement includes a secondary passage through the shaft positioned such that when the main passage is blocked, the secondary passage is open to allow the minimum air flow condition.

5. The texture spray gun of claim 1, wherein the trigger is attached to the gun body by a pivot and is rotationally movable with respect to the pivot about a pivot radius to selectively control a discharge of semi-solid slurry material, wherein the trigger has a first section distal of the pivot and a second section proximal of the pivot and positioned between the first section and the pivot, wherein the first section is aligned with a first angle with respect to the pivot radius and the second section has a second angle with respect to the pivot radius.

6. The texture spray gun of claim 5, wherein the first angle is larger than the second angle.

7. The texture spray gun of claim 5, wherein the difference between the first and second angles is about 12 degrees.

8. The texture spray gun of claim 5, wherein the first angle is about 44 degrees and the second angle is about 32 degrees.

9. The texture spray gun of claim 1, wherein the trigger is attached to the gun body by a pivot and is rotationally movable with respect to the pivot to sequentially control a discharge of air and a discharge of the semi-solid slurry material from the gun wherein the discharge of air is started before the discharge of the semi-solid slurry material when the trigger is pulled, and the discharge of the semi-solid slurry material is stopped before the discharge of air when the trigger is released.

10. The texture spray gun of claim 1, wherein pulling the trigger moves a main shaft in the gun and the minimum distance corresponds to at least 0.090 inches movement or the main shaft.

11. The texture spray gun of claim 1, wherein the texture material passageway is fluidically coupled to a semi-solid slurry material source and provides the semi-solid texture material in the form of a slurry to the texture nozzle.

* * * * *